US006098598A

United States Patent [19]

Riefenstahl et al.

[11] Patent Number: 6,098,598

[45] Date of Patent: Aug. 8, 2000

[54] FUEL INJECTION VALVE

[75] Inventors: Jochen Riefenstahl, Litzendorf; Henning Teiwes, Hallstadt; Gottfried Flik, Leonberg; Ottmar Martin, Hochdorf/Eberdingen, all of Germany

[73] Assignee: Robert Bosch GmbH, Stuttgart, Germany

[21] Appl. No.: 09/242,194

[22] PCT Filed: Apr. 8, 1998

[86] PCT No.: PCT/DE98/00985

§ 371 Date: Feb. 10, 1999

§ 102(e) Date: Feb. 10, 1999

[87] PCT Pub. No.: WO98/58168

PCT Pub. Date: Dec. 23, 1998

[30] Foreign Application Priority Data

Jun. 14, 1997 [DE] Germany ..... 197 25 198

[51] Int. Cl.[7] ..... F02M 37/04

[52] U.S. Cl. ..... 123/472; 251/121; 239/533.3

[58] Field of Search ..... 123/510, 472; 251/121, 122; 137/613; 239/533.3, 533.5, 533.6, 533.7

[56] References Cited

U.S. PATENT DOCUMENTS

| | | | |
|---|---|---|---|
| 3,343,798 | 9/1967 | Senft | 239/533.3 |
| 3,361,353 | 1/1968 | Millman | 239/533.6 |
| 4,046,322 | 9/1977 | Knape et al. | 239/533.7 |
| 4,080,156 | 3/1978 | Moriya | 251/121 |
| 4,552,310 | 11/1985 | Gaskell | 239/533.5 |
| 5,383,606 | 1/1995 | Stegmaier et al. | 239/900 |

FOREIGN PATENT DOCUMENTS

| | | |
|---|---|---|
| 494 740 | 3/1930 | Germany . |
| 44 31 128 | 3/1996 | Germany . |
| 196 00 403 | 8/1996 | Germany . |

*Primary Examiner*—Thomas N. Moulis
*Attorney, Agent, or Firm*—Kenyon & Kenyon

[57] ABSTRACT

A fuel injection valve in particular an injection valve for fuel injection systems of internal combustion engines has a valve closing body connected to a valve needle and a valve seat body. A valve closing surface that cooperates with a valve seat surface configured on valve seat body to form valve seat on valve closing body. Furthermore, the fuel injection valve has at least one fuel channel provided in the area of the valve seat body upstream from the valve seat for supplying fuel to the fuel seat. A throttle point, whose opening cross section can be varied from outside the fuel injection valve, is arranged in each fuel channel.

12 Claims, 2 Drawing Sheets

FUEL INJECTION VALVE

BACKGROUND INFORMATION

A fuel injection valve is described in German Patent No. 49 47 40, in which a valve closing body connected with a valve needle cooperates with a valve seat body for a valve seat. An essentially axial fuel line, opening into a fuel channel running in the radial direction in the valve seat body, is provided in the nozzle body to guide the fuel. The fuel channel opens into a spray orifice in the area of the valve seat.

Another fuel injection valve for direct injection of fuel into a cylinder of an internal combustion engine is described in German Patent Application No. 196 00 403.

A disadvantage of the conventional fuel injection valves is that the amount of fuel metered by the fuel injection valves is defined by the stroke of the fuel injection valves. The stroke of the fuel injection valves is, however, relatively complicated to alter and can only be modified within narrow limits once the fuel injection valve is assembled. Fine adjustment of the metered fuel amount is therefore relatively complicated with the conventional fuel injection valves.

Furthermore, the fuel distribution within the fuel jet exiting the conventional fuel injection valves is largely radially symmetric. In practice, however, asymmetric fuel distribution within the fuel jet is desirable under certain circumstances. Thus, for example, a fuel-air mixture composition that is different in the spark plug region from the rest of the fuel jet may be advantageous.

SUMMARY OF THE INVENTION

The fuel injection valve according to the present invention has the advantage that it make an accurate adjustment of the amount of fuel metered by the fuel injection valve possible in that the opening cross section of a throttle point of the one fuel channel or the plurality of fuel channels can be selectively modified. The amount of fuel metered by the fuel injection valves according to the present invention can be adjusted in a relatively short time in a simple manner, fully automatically. Manufacturing costs are thereby considerably reduced.

If a plurality of fuel channels distributed over the periphery of the valve seat body and the opening cross sections of the throttle points in the fuel channels can be modified independently of one another, this offers the advantage that the fuel distribution in the fuel jet exiting the fuel injection valve can be adjusted so that it becomes asymmetrical. In the region where a higher fuel density is desired, the opening cross section of the fuel channel located there must be increased, while in a region where a lower fuel density is desired, the orifice diameter of the fuel channel located there must be reduced. The resulting asymmetric shape of the fuel jet allows the fuel distribution to be adjusted to the construction geometry and the special design of the internal combustion engine, for example, to the position of the spark plugs and valves in the case of fuel injection valves that inject directly into the cylinder of the internal combustion engine or to the special geometric shape of the intake manifold in the case of fuel injection valves that inject into the intake manifold of the internal combustion engine. In particular, the amount of fuel sprayed onto the wall areas of the cylinder or the intake manifold can be reduced, which translates into improved exhaust gas parameters.

It is also advantageous that the fuel distribution can be modified even after the fuel injection valve has been fully assembled, since the location of the fuel injection valve in the internal combustion engine and the specific geometric shape of the internal combustion engine components can vary considerably depending on the engine type, i.e., from one type of vehicle to another.

The throttle point can be designed in an advantageous and simple manner by the fact that a nozzle body surrounding the valve seat body is subjected to plastic deformation from the outside, for example, using a bolt element and the fuel channel is constricted according to its deformation. The opening cross section of the throttle point can be advantageously adjusted in a particularly simple manner using an automatic device.

The use of a manipulator inserted in the fuel channel, whose depth of insertion determines the opening cross section of the throttle point of the respective fuel channel, is particularly advantageous. In this embodiment, it is advantageous that the opening cross section of the throttle point can be either reduced or enlarged, which simplifies the adjustment process. Welding the manipulator to the valve seat body produces both fastening and sealing at the same time.

DETAILED DESCRIPTION

Figure 1:
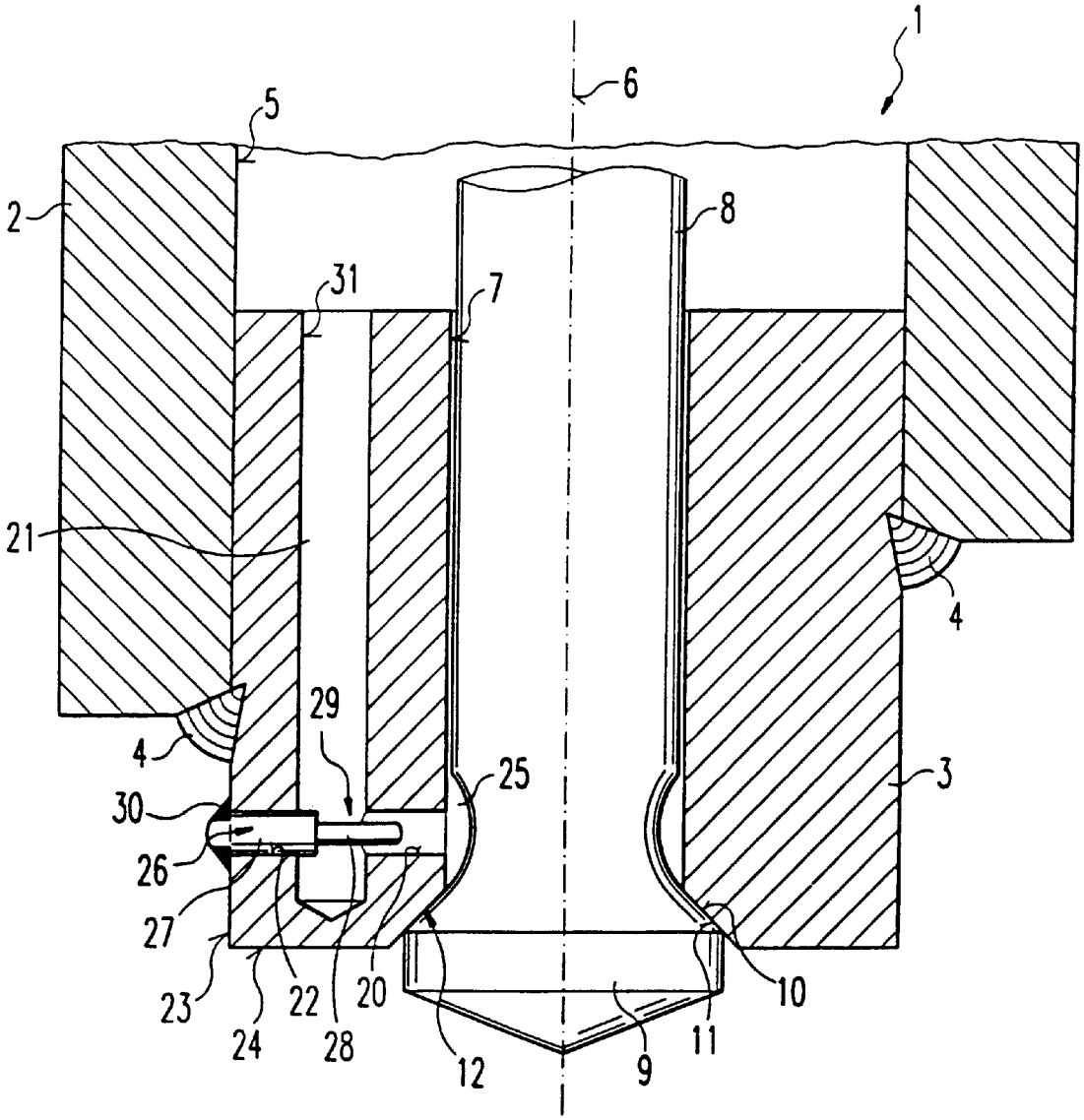
FIG. 1 shows an axial section through a portion of a first embodiment of a fuel injection valve according to the present invention.

FIG. 1 shows an axial section through a portion of a first embodiment of a fuel injection valve 1 according to the present invention. Only the fuel outlet end of fuel injection valve 1 is illustrated.

A valve seat body 3 is arranged inside and at the outlet end of a nozzle body 2 that has the shape of a hollow cylinder; valve seal body is sealingly bonded to nozzle body 2 with welding seam 4. Valve seat body 3 also essentially has the shape of a hollow cylinder with the inner diameter of nozzle body 2 being essentially equal to the outer diameter of valve seat body 3, so that valve seat body 3 fits into inner orifice 5 of nozzle body 2. Valve seat body 3 has a guide bore 7, concentric to its longitudinal axis, which coincides with the longitudinal axis 6 of fuel injection valve 1 and serves to guide valve needle 8.

Valve needle 8 is cylinder-shaped and made of one piece with a valve closing body 9 in this embodiment. To reduce the inertial mass, valve needle 8 can, however, also have a hollow cylinder shape or be made of a round-bent sheet metal part. Valve closing body 9 has a conical valve closing surface 10, which cooperates with a similarly conical valve seat surface 11, arranged on the outlet side of valve seat body 3 forming a valve seat 12 closing on the outside. Valve needle 8 and valve closing body 9, connected to valve needle 8, can be actuated along longitudinal axis 6 using an electromagnetic or piezoelectric actuating element, for example, with a translational stroke. A resetting element (not illustrated), designed as a restoring spring, for example, holds valve closing surface 10 of valve closing body 9 in the closed position of fuel injection valve 1 flush with valve seat surface 10 of valve seat body 3. Valve seat 12, opening on the outside, is well-suited for a fuel injection valve 1 for direct injection of fuels into a cylinder or the combustion chamber of an internal combustion engine, since the combustion pression prevailing in the combustion chamber acts upon valve closing body 9 in the direction of closing and does not cause fuel injection valve 1 to accidentally open.

According to the present invention, at least one fuel channel is provided, but preferably a plurality of fuel channels are provided, in valve seat body 3. The fuel channel has a first, radial, section 20 and a second, axial, section 21 connected to first section 20. The first, radial, section 20 of fuel channel 20, 21 is part of a through bore 22, extending from the outer cylindrical surface 23 of valve seat body 3 through valve seat body 3 to guide bore 7. The second, axial, section 21 of fuel channel 20, 21 is designed as a pocket hole 31 in this embodiment. It would also be possible to design also the second section 21 of fuel channel 20, 21 as a through bore and close it on outlet-side end face 24 of valve seat body 3 using a suitable closure. The first, radial, section 20 of fuel channel 20, 21 opens into an annular groove 25 on valve needle 8, regardless of the stroke position of valve needle 8.

A manipulator 26, designed as a stepped cylinder, can be introduced in bore hole 22 from the orifice of this bore hole located on the outer cylindrical surface 23 of valve seat body 3. Manipulator 26 has a guide section 27, matching the diameter of through bore 22, and a rod-shaped section 28 with a smaller diameter. As can be seen in FIG. 1, the opening cross section of fuel channel 20, 21 is increasingly reduced with an increasing depth of insertion of manipulator 26 in through bore 22, i.e., in fuel channel 20, 21. Manipulator 26 forms therefore a throttle point 29 with adjustable opening cross section. The opening cross section of this throttle point 29 can be easily varied even when fuel injection valve 1 is fully assembled. After the opening cross section of throttle point 29 has been set, manipulator 26 is sealingly bonded to valve seat body 3, in this embodiment with welding seam 30. Thus manipulator 26 is fastened on valve seat body 3 and at the same time the fuel is prevented from exiting from through bore 22 outward.

Preferably a plurality of fuel channels 20, 21, uniformly arranged on a concentric circular segment are provided in valve seat body 3. Throttle points 29 of the individual fuel channels 20, 21 can be adjusted independently of each other using their respective manipulators 26. Thus a radially asymmetric fuel distribution can be obtained in the fuel jet exiting from fuel injection valve 1, since the fuel distribution in peripheral groove 25 of valve needle 8 is non-uniform due to the differently throttled fuel supply through the differently throttled fuel channels 20, 21. Such an asymmetric fuel distribution in the fuel jet is advantageous, for example, if the proportion of fuel in the fuel-air mixture is to be reduced in the area of individual components, e.g., a spark plug, the cylinder intake or exhaust valves, or the cylinder or intake manifold wall areas. Thus the combustion in the internal combustion engine can be optimized and the exhaust gas parameters can be considerably improved.

It is also advantageous that the fuel distribution can be varied by adjusting manipulators 26 even with fuel injection valve 1 fully assembled, and the fuel distribution in the fuel jet exiting fuel injection valve 1 can be adjusted to the specific geometry of the engine or the vehicle type, for example.

Figure 2:
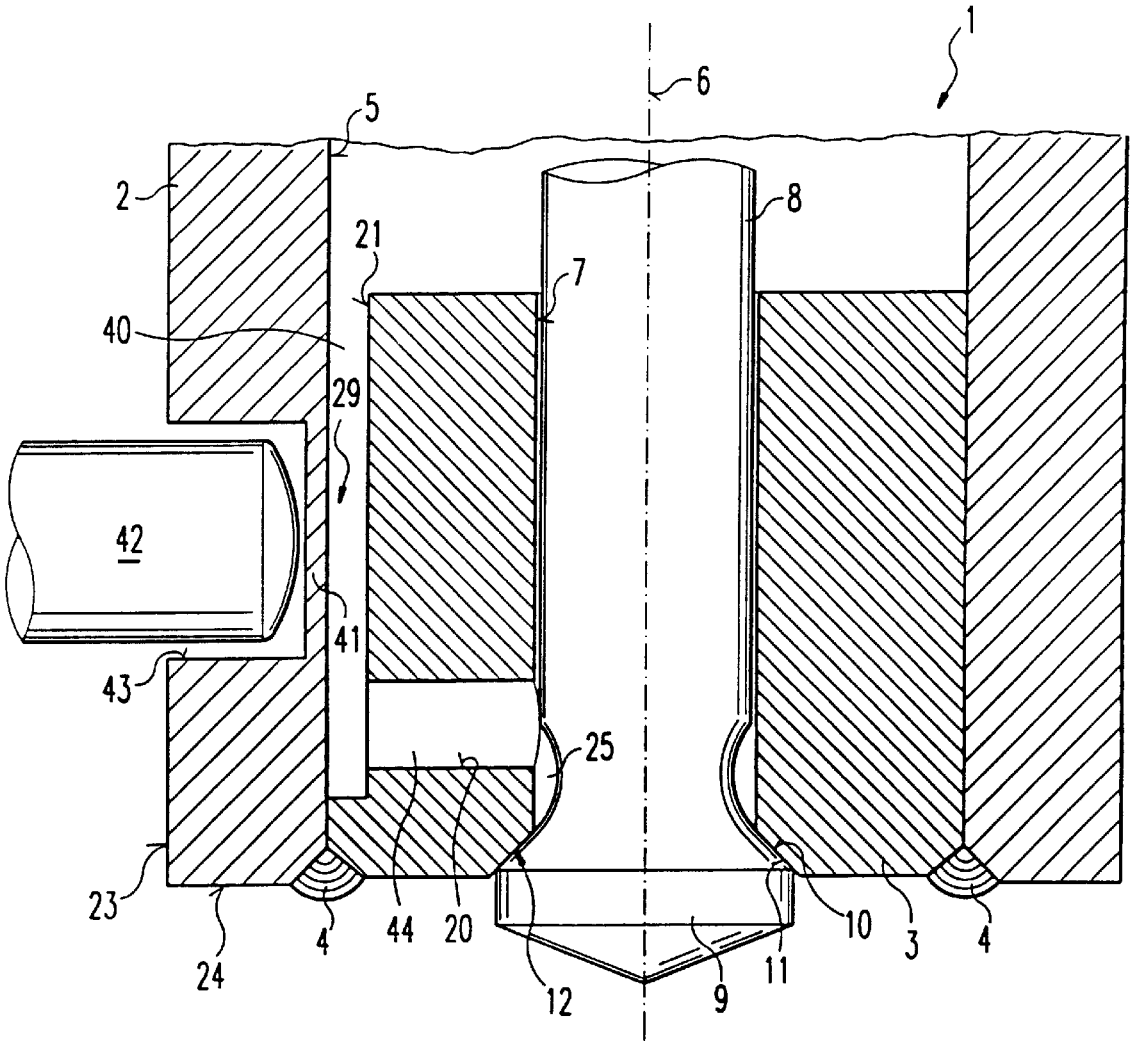
FIG. 2 shows an axial section through a portion of a second embodiment of the fuel injection valve according to the present invention.

FIG. 2 shows a section through a portion of a second embodiment of a fuel injection valve 1 according to the present invention. Elements already described are provided with the same symbols, so that repetitions can be avoided in the description.

The first, radial, section 20 of each fuel channel 20, 21 is designed in the embodiment illustrated in FIG. 2 as radial bore 44 opening into annular groove 25 of valve needle 8. The second, axial, section 21 of each fuel channel 20, 21 is designed in the embodiment illustrated in FIG. 2 as groove 40, formed on a flat section 21 on valve seat body 3. Groove 40 is connected to both internal orifice 5 of nozzle body 2 and first section 20 of fuel channel 20, 21.

In contrast to the embodiment shown in FIG. 1, throttle point 29 is not formed by a manipulator 26, but by the plastic deformation of a wall 41 of nozzle body 2, which has a reduced thickness in the area of throttle point 29. Wall 41 can be deformed using a bolt element 42, for example, which penetrates into a depression 43 in nozzle body 2 and engages with thin wall 41 of nozzle body 2. The amount of fuel metered by fuel injection valve 1 can therefore be adjusted fully automatically when fuel injection valve 1 is fully assembled, so that throttle point 29 is gradually narrowed until the amount of fuel to be metered by fuel injection valve 1 is attained. The advantage of the design according to the present invention is that the valve stroke does not need to be modified to adjust the fuel amount metered by fuel injection valve 1.

Preferably a plurality of grooves 40, distributed along the periphery of valve seat body 3, are provided, each connected to annular groove 25 of valve needle 8 via a radial bore 44. As described above with respect to the embodiment shown in FIG. 1, the individual opening cross sections of throttle points 29 of the individual grooves 40 can be adjusted independently of each other. This can be achieved in an automatic device either consecutively by turning fuel injection valve 1 around its longitudinal axis 6 and a bolt element 42 that consecutively penetrates in all depressions 43, or simultaneously using bolt elements 42 provided on the automatic device, which adjust all the throttle points 29 simultaneously. The total amount of fuel can be adjusted by displacing valve seat body 3 and thus adjusting the valve stroke, and by applying welding seam 4 for fastening valve seat body 3. Then, or optionally previously, a radially asymmetric fuel distribution can be set by pressing wall 41 of nozzle body 2 at each throttle point 29. Furthermore, a fine adjustment of the amount of fuel to be metered by fuel injection valve 1 can be performed at the same time.

The present invention is not limited to the embodiments described above. Instead of forming flats 21, axial grooves 40 can also be cut into valve seat body 3. Furthermore, other throttling methods can be used, such as are known from shutoff valves. It is also not absolutely necessary to form fuel channel(s) 20, 21 in or on valve seat body 3. At least sections of fuel channels 20, 21 can be arranged in or on nozzle body 2.

What is claimed is:

1. A fuel injection valve, comprising:

a valve seat body having a valve seat surface;

a valve needle;

a valve closing body coupled to the valve needle, the valve closing body having a valve closing surface which cooperates with the valve seat surface of the valve seat body to form a valve seat; and at least one fuel channel situated in an area of the valve seat body upstream from the valve seat to supply fuel to the valve seat, wherein the at least one fuel channel includes a throttle section having an opening cross section, the opening cross section being modifiable from outside of the fuel injection valve.

2. The fuel injection valve according to claim 1, wherein the at least one fuel channel includes a plurality of fuel channels peripherally distributed in the particular area, wherein the fuel channels include corresponding throttle sections having respective opening cross sections, and wherein one of the respective opening cross sections is variable independently from another one of the respective opening cross sections to form an asymmetric fuel distribution in one of fuel jets which exits the fuel injection valve.

3. The fuel injection valve according to claim 1, wherein the at least one fuel channel includes a first section, the first section extending through the valve seat body, via a radial component, upstream from the valve seat surface.

4. The fuel injection valve according to claim 3, wherein the at least one fuel channel includes a second section disposed upstream from the first section and extending on or in the valve seat body in an axial direction of the fuel injection valve.

5. The fuel injection valve according to claim 3, wherein the at least one fuel channel includes a second section extending through the valve seat body, the second section having a shape of an axial bore.

6. The fuel injection valve according to claim 3, wherein the at least one fuel channel includes a second section disposed on the valve seat body and having a shape of an axial groove.

7. The fuel injection valve according to claim 6, further comprising:

a nozzle body surrounding the valve seat body and having a plastic portion which is radially deformable in a direction of the valve seat body for changing the opening cross section of the throttle point, wherein the nozzle body closes the axial groove from an external environment.

8. The fuel injection valve according to claim 7, further comprising:

a bolt element cooperating with a wall of the nozzle body to produce a deformation in the wall, the wall having a reduced thickness at the throttle point to permit the deformation.

9. The fuel injection valve according to claim 1, further comprising:

a manipulator disposed in the at least one fuel channel at a particular insertion depth, the particular insertion depth defining the opening cross section of the throttle point, wherein the manipulator is displaceable externally from the fuel injection valve.

10. The fuel injection valve according to claim 9, wherein the manipulator is welded to the valve seat body.

11. The fuel injection valve according to claim 1, wherein one of the valve needle and the valve closing body has an annular groove, and wherein the at least one fuel channel opens into the annular grove.

12. The fuel injection valve according to claim 1, wherein the fuel injection valve is provided for a fuel injection system of an internal combustion engine.

* * * * *